US006739290B2

(12) United States Patent
Iwasaki et al.

(10) Patent No.: US 6,739,290 B2
(45) Date of Patent: May 25, 2004

(54) COOLING SYSTEM FOR WATER-COOLED INTERNAL COMBUSTION ENGINE AND CONTROL METHOD APPLICABLE TO COOLING SYSTEM THEREFOR

(75) Inventors: Mitsuru Iwasaki, Kanagawa (JP); Kazunori Namai, Tokyo (JP); Hironori Muramoto, Kanagawa (JP); Michitake Sumida, Yokohama (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/091,352

(22) Filed: Mar. 6, 2002

(65) Prior Publication Data

US 2002/0152972 A1 Oct. 24, 2002

(30) Foreign Application Priority Data

Mar. 6, 2001 (JP) ..... 2001-061840

(51) Int. Cl.[7] ..... F01P 7/16

(52) U.S. Cl. ..... 123/41.05; 123/41.01; 123/41.44

(58) Field of Search ..... 123/41.05, 41.44, 123/41.01

(56) References Cited

U.S. PATENT DOCUMENTS

| | | | | |
|---|---|---|---|---|
| 2,277,113 A | | 3/1942 | Kimmel | |
| 3,939,901 A | | 2/1976 | Cieszko et al. | |
| 3,989,103 A | | 11/1976 | Cieszko et al. | 165/110 |
| 5,419,287 A | * | 5/1995 | Evans | 123/41.01 |
| 5,724,924 A | * | 3/1998 | Michels | 123/41.12 |
| 5,970,927 A | * | 10/1999 | Suzuki | 123/41.29 |
| 6,178,928 B1 | * | 1/2001 | Corriveau | 123/41.44 |
| 6,247,429 B1 | * | 6/2001 | Hara et al. | 123/41.44 |
| 6,289,854 B1 | * | 9/2001 | Holmstrom et al. | 123/41.44 |
| 6,318,307 B1 | | 11/2001 | Heer | 123/41.44 |
| 6,343,572 B1 | * | 2/2002 | Pfaff et al. | 123/41.01 |
| 6,352,055 B1 | * | 3/2002 | Algrain et al. | 123/41.44 |
| 6,363,918 B2 | * | 4/2002 | Hakansson et al. | 123/41.44 |
| 6,364,213 B1 | * | 4/2002 | Baltz | 123/41.01 |
| 6,394,045 B1 | * | 5/2002 | Perset | 123/41.44 |
| 6,405,689 B1 | * | 6/2002 | Iijima | 123/41.44 |

FOREIGN PATENT DOCUMENTS

| | | |
|---|---|---|
| DE | 198 03 884 A1 | 8/1999 |
| EP | 0 965 737 A2 | 12/1999 |
| JP | 2000-45774 | 2/2000 |

* cited by examiner

*Primary Examiner*—Henry C. Yuen
*Assistant Examiner*—Jason Benton
(74) *Attorney, Agent, or Firm*—Foley & Lardner LLP

(57) ABSTRACT

In a cooling system for a water-cooled internal combustion engine and a control method applicable to the control system, a pump to circulate a coolant to the water-cooled engine and a heat exchanger is drivingly controlled in such a manner that, when a temperature of the coolant detected by a temperature detector indicates a value higher than a predetermined target temperature, a flow state of the coolant circulated within a plurality of tubes arranged within the heat exchanger falls within a predetermined range including at least one of a transition range between a laminar flow range and a turbulence flow range and a part of the turbulence flow range which is placed in vicinity to the transition range (corresponding to 1800 through 6000 in Reynolds number) and the coolant is circulated through the pump into the water-cooled engine and the heat exchanger by a predetermined flow quantity.

11 Claims, 10 Drawing Sheets

COOLING SYSTEM FOR WATER-COOLED INTERNAL COMBUSTION ENGINE AND CONTROL METHOD APPLICABLE TO COOLING SYSTEM THEREFOR

BACKGROUND OF THE INVENTION:

1. Field of the Invention

The present invention relates generally to a cooling system and a control method applicable to the cooling system for a water- (or, liquid-) cooled internal combustion engine and, more particularly, relates to cooling system and control method applicable to the cooling system therefor in which a water pump to circulate an engine coolant to the engine is driven by means of its associated motor.

2. Description of the Related Art

A first previously proposed cooling system for the water-cooled engine includes the water pump driven in proportion to a revolution speed of the engine so that the coolant (a cooling water) is circulated into a cylinder head and a cylinder block. However, in the first previously proposed cooling system described above, since a flow quantity of the coolant is proportional to the revolution speed of the engine, an excessive amount of the coolant is circulated unnecessarily, in, for example, a winter season, and an extra amount of the coolant is unnecessarily circulated during a high speed run of an automotive vehicle in which the first previously proposed cooling system is mounted. Therefore, the first previously proposed water-cooled engine cooling system using the water pump generates an extra heat radiation of the coolant so that a delay in an engine warm-up occurs and has a considerably large loss in power. Furthermore, since only the revolution speed of the engine determines the flow quantity of the coolant, a high-temperature control cannot be achieved. To reduce the power loss described above, a Japanese Patent Application First Publication No. 2000-045774 published on Feb. 15, 2000 exemplifies a second previously proposed cooling system. In the above-described second previously proposed cooling system, a conventional water pump is replaced with a motor-driven water pump and such a control that a difference in temperature of the coolant at an outlet of the engine coolant and at an inlet of the engine coolant indicates a predetermined difference value is executed.

SUMMARY OF THE INVENTION

In general, if the circulation quantity of water is varied by means of the water pump, the coolant (or a cooling water) indicates a laminar flow state or a turbulence state depending upon a flow quantity of the coolant which is circulated through a multiple number of tubes disposed within headers of a radiator. For example, if the flow velocity of the coolant within the tubes is reduced and is below a predetermined flow velocity, the coolant becomes a laminar-flow state. A cooling efficiency is reduced at the radiator so that the engine is not well cooled and an increase in a power of a radiator fan cannot be avoided. In addition, in a case where the flow velocity of the coolant within the tubes becomes increased to indicate the turbulence flow state in the tubes, a further increase in the flow velocity of the coolant cannot provide a cause of the increase in the cooling efficiency and, in turn, the power required to cool the engine is increased.

These problems are applied equally well to the second previously proposed cooling system. That is to say, in each of the previously proposed cooling systems, even if the water pump is driven by means of the motor and even if a control such that the difference in the coolant temperature between at the outlet of the engine coolant and at the inlet of the engine coolant indicates the predetermined temperature difference is executed, the flow velocity of the coolant within the tubes of the radiator cannot be yet controlled. Therefore, in a case where the coolant becomes laminar, the cooling efficiency at the radiator becomes reduced and the coolant is not sufficiently cooled. Thus, the increase in the power of the radiator fan is required. On the contrary, if the flow velocity of the coolant is increased and the coolant becomes turbulence flow state, the cooling efficiency to meet with the increase in a working efficiency of the motor-driven pump cannot be achieved even if a working rate of the motor-driven pump is increased.

Furthermore, an excessive work of the motor-driven pump can possibly provide a cause of an erosion in the tubes It is, therefore, an object of the present invention to provide cooling system for a water-cooled internal combustion engine and a control method applicable to the cooling system therefor in which a pump power to circulate the coolant is suppressed, a wasteful work of the radiator fan is prevented from occurring, an extra heat radiation of the coolant is prevented from occurring to fasten an engine warm-up, and an improvement in a fuel consumption of the water-cooled engine can be achieved.

According to one aspect of the present invention, there is provided a cooling system for a water-cooled internal combustion engine, comprising: a heat exchanger to circulate a coolant flowing out from the water-cooled engine into tubes arranged in a space between headers thereof to cool the coolant; a pump driven independently of the water-cooled engine to circulate the coolant into the water-cooled engine and the heat exchanger; a temperature detector to detect a temperature of the coolant; and a controller that drivingly controls the pump on the basis of a detected value of the coolant temperature by the temperature detector in such a manner as to control the drive of the pump for the coolant to be circulated by a predetermined flow quantity, when the temperature of the coolant detected by the temperature detector indicates a value higher than a predetermined target temperature, the heat exchanger being arranged, at the predetermined flow quantity of the coolant, to cause a stream state of the coolant circulated within the tubes of the heat exchanger to fall within a predetermined range including at least one of a transition range between a laminar flow range and a turbulence flow range and a part of the turbulence flow range which is placed in vicinity to the transition range.

According to another aspect of the present invention, there is provided a cooling system for a water-cooled internal combustion engine, comprising: a heat exchanger to circulate a coolant flowing out from the water-cooled engine into tubes arranged in a space between headers thereof to cool the coolant; a pump driven independently of the water-cooled engine to circulate a coolant to the water-cooled engine and the heat exchanger; a temperature detector to detect a temperature of the coolant; and a controller that drivingly controls the pump on the basis of a detected value of the coolant temperature by the temperature detector in such a manner as to control the drive of the pump for the coolant to be circulated by a predetermined flow quantity, when the temperature of the coolant detected by the temperature detector indicates a value higher than a predetermined target temperature, the heat exchanger being arranged, at the predetermined flow quantity of the coolant, to cause Reynolds number of the coolant circulated within the tubes of the heat exchanger to fall in a range between 1800 and 6000.

According to a still another aspect of the present invention, there is provided a control method applicable to a control system for a water-cooled internal combustion engine, the control system comprising: control method applicable to a control system for a water-cooled internal combustion engine, the control system comprising: a heat exchanger to circulate a coolant flowing out from the water-cooled engine into tubes arranged in a space between headers thereof to cool the coolant; a pump driven independently of the water-cooled engine to circulate the coolant to the water-cooled engine and the heat exchanger; and a temperature detector to detect a temperature of the coolant, the control method comprising: determining whether the temperature of the coolant detected by the temperature detector indicates a value higher than a predetermined target temperature; drivingly controlling the pump on the basis of a detected value of the coolant temperature by the temperature detector in such a manner as to control the drive of the pump for the coolant to be circulated by a predetermined flow quantity, when determining that the temperature of the coolant detected by the temperature detector indicates a value higher than a predetermined target temperature, at the predetermined flow quantity of the coolant; and causing a stream state of the coolant circulated within the tubes of the heat exchanger to fall within a predetermined range including at least one of a transition range between a laminar flow range and a turbulence flow range and a part of the turbulence flow range which is placed in vicinity to the transition range.

This summary of the invention does not necessarily describe all necessary features so that the invention may also be a sub-combination of these described features.

DETAILED DESCRIPTION OF THE PREFERRED EMBODIMENTS

Reference will hereinafter be made to the drawings in order to facilitate a better understanding of the present invention.

(First Embodiment)

Figure 1:
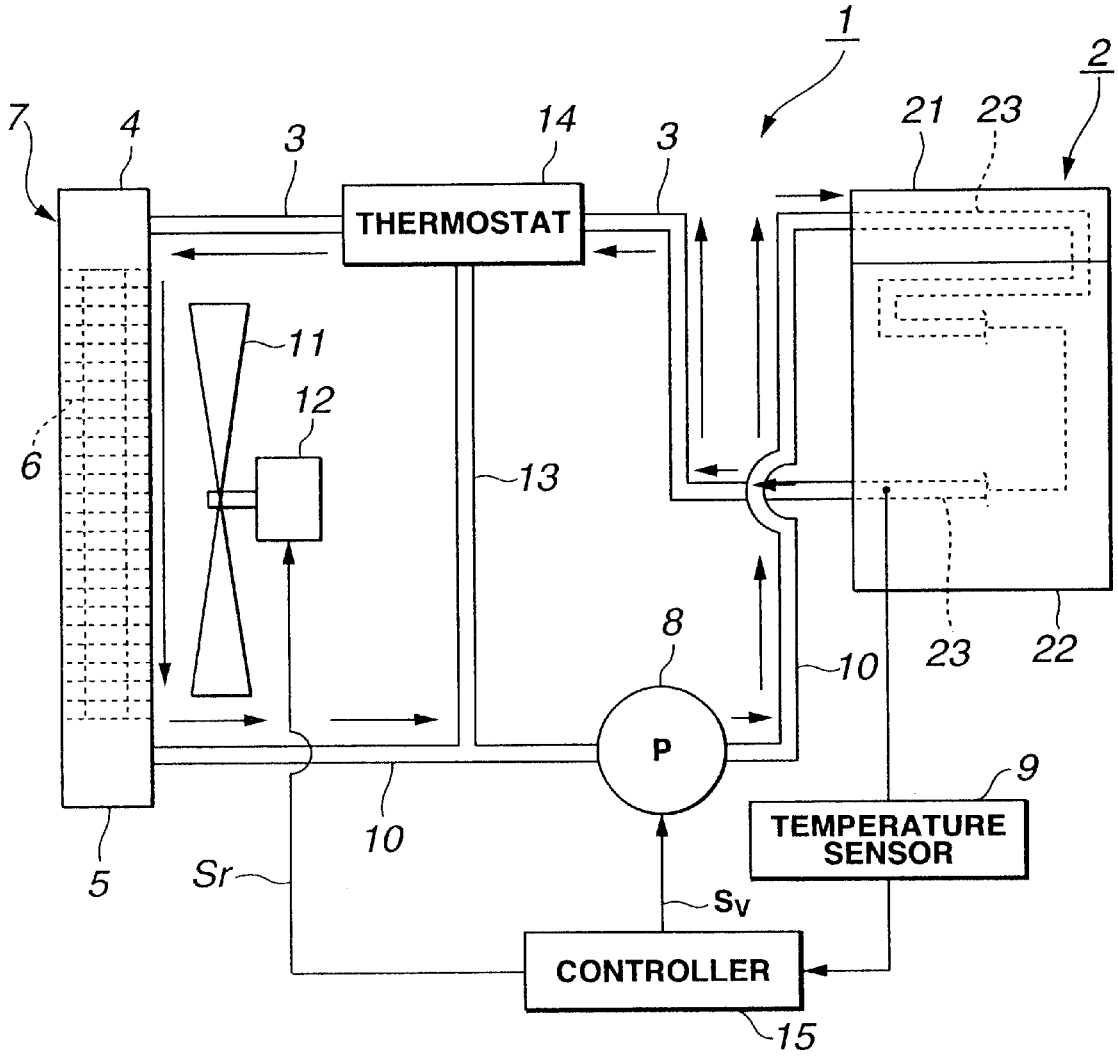
FIG. 1 is a schematic block diagram of a water-cooled internal combustion engine to which a cooling system according to the present invention in a first preferred embodiment is applicable and in which the coolant is caused to flow through the engine and heat exchanger.
Figure 2:
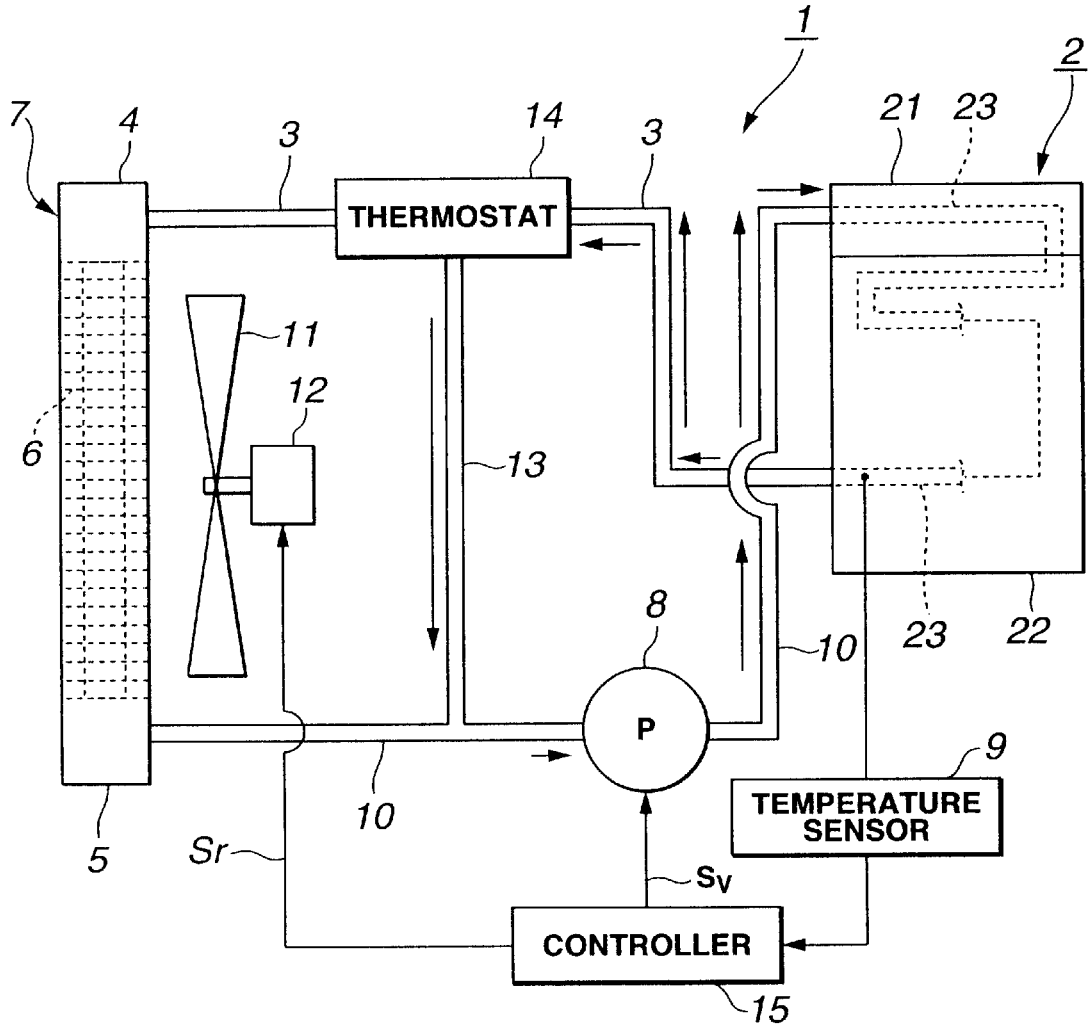
FIG. 2 is a schematic block diagram of the cooling system for the water-cooled internal combustion engine according to the present invention in which the coolant is caused to flow through a bypass circuit of the cooling system shown in FIG. 1.

FIGS. 1 and 2 show explanatory views for explaining a water-cooled internal combustion engine to which a cooling system 1 in a first preferred embodiment according to the present invention is applicable.

Cooling system 1 in the first embodiment according to the present invention includes: a radiator 7 as a heat exchanger to circulate a coolant outputted from a water-cooled engine 2 via a coolant circulation tube 3 and to cool the coolant with the coolant circulated into tubes 6 interposed between headers 4 and 5; a motor-driven pump 8 to be driven independently of engine 2 to circulate the coolant into engine 2 and radiator 7; a temperature sensor 9 as temperature detecting means for detecting a coolant temperature Tw within engine 2; a coolant circuit 10 in a midway through which above-described motor-driven pump 8 is interposed to circulate the coolant from radiator 7 to engine 2; a rotational drive motor (or called, fan motor) 12 in which a fan 11 to serve to supply air (wind) to tubes 6 of radiator 7 is provided; an electrically controllable thermostat (valve) 14 which is interposed on a midway through coolant circulation tube 3 and which controllably bypasses the coolant supplied from engine 2 toward radiator 7 via a bypass circuit 13 toward a suction side of motor-driven pump 8 in accordance with the coolant temperature as will be described later, i.e., which controls a distribution of the coolant flow quantity supplied from engine 2 toward radiator 7 and bypassed through bypass circuit 13 toward a suction side of motor-driven pump 8 in accordance with coolant temperature Tw; and a controller 15 which controls the flow distribution rate of thermostat 14, a drive output of motor-driven pump 8, and a revolution speed of fan motor 12 on the basis of the detected value of temperature sensor 9, as will be described later.

In the first embodiment, a coolant circulation passage 23 is formed on a linkage between a cylinder head 21 and a cylinder block 22 in engine 2. An end of coolant circulation passage 23 located at cylinder head 21 is connected to coolant circuit 10 and another end of coolant circulation passage 23 located at cylinder block 22 is connected to coolant circuit 3. That is to say, in the first embodiment, the coolant discharged from motor-driven pump 8 enters through cylinder head 21 and exits through cylinder block 22.

Radiator 7 is constructed in a structural form of a, so-called, a longitudinal flow in which a multiple number of tubes 6 are equipped so that headers 4 and 5 are juxtaposed to tubes 6. However, radiator 7 constructed in a, so-called, lateral flow structural form may be used. It is noted that tubes 6 may properly have a plate fin or corrugated fin for the heat exchanger. In the first embodiment, coolant circulation tube 3 is connected to the end of coolant circulation passage 23 of cylinder block 22 and is connected to an upper header 4. In the first embodiment, thermostat 14 interposed in the midway through coolant circuit 3 is set to gradually open coolant circulation passage 3 connected between that located at cylinder block 22 and upper header 4 when, for example, the temperature of the coolant is equal to or higher than 100° C. and is set to completely close bypass circuit 13 while completely open the coolant circulation tube 3 when the temperature of coolant Tw is equal to or higher than 105° C. If temperature Tw is below 100° C., thermostat 14 is set to close coolant circulation passage 3 and to cause the coolant to flow into bypass circuit 13. It is noted that thermostat 14 may be interposed on a midway through coolant circuit 10 connecting a lower header 5 to engine 2 and may be set to open coolant circuit 10 when, for example, temperature Tw of the coolant is equal to or higher than 100° C. and to close coolant circuit 10 so that the coolant is supplied to engine 2 via bypass circuit 13 when temperature Tw is below 100° C.

In addition, rotational drive motor 12 is connected to controller 15. Fan 11 to supply a wind to tube 6 of radiator 7 is attached onto rotational drive motor 12 and the revolution speed of motor 12 is controlled on the basis of a revolution speed control signal Sr from controller 15. Motor-driven pump 8 serves to vary the flow of the coolant passing therethrough on the basis of a flow velocity control signal Sr issued from controller 15.

Temperature sensor 9 is arranged so as to enable a temperature detection placed in the vicinity to an end portion of coolant circulation passage 23 on cylinder block 22. A detection probe of temperature sensor 9 is inserted within cylinder block 22 but temperature sensor 9 may detect the coolant temperature Tw at a position placed in the vicinity to an outlet of coolant circulation passage 23.

In this embodiment, the flow velocity of the coolant generated by motor-driven pump 8, particularly, the flow velocity within tubes 6 of radiator 7 and the revolution speed of rotational drive motor 12 of fan 11 are controlled by controller 15. A reduction in power loss is achieved by a specification of a characteristic of the coolant circulated within tubes 6 of radiator 7 during a high load. It is, at this time, made possible to achieve a remarkable fuel economy.

Before explaining control and operation of cooling system 1 for the water-cooled engine in this embodiment, a relationship from among a coolant Reynolds number, a fan velocity, and power required to cool engine 2 will be described with reference to FIG. 3.

Figure 3:
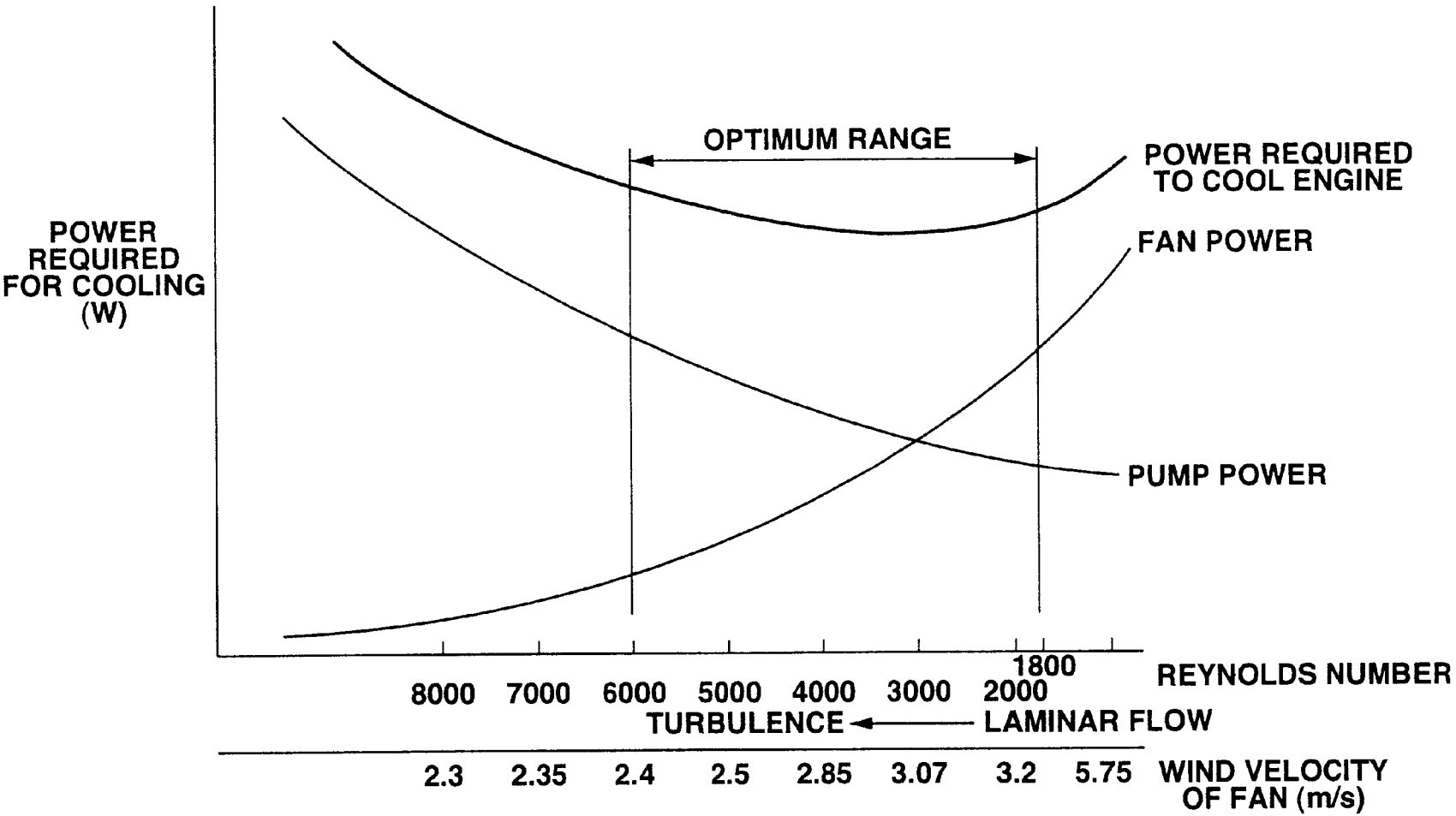
FIG. 3 is a characteristic graph representing a relationship from among a power required to cool the engine, radiator side coolant Reynolds numbers, and wind velocity of a fan, and a relationship between a fan motor power and a pump drive power.

A graph shown in FIG. 3 represents a power required to cool engine 2 during a high load state (a state in which a coolant temperature has reached to 100° C. and the coolant is circulated through radiator 7) in the generally available longitudinal flow type radiator having a lateral dimension of the core portion (heat radiating portion) being 691.5 mm, the longitudinal dimension being 360 mm, and a depth dimension being 16 mm. In FIG. 3, a lateral axis denotes the coolant Reynolds number of radiator 7 and the fan wind velocity in m/sec and the longitudinal axis denotes a power (in W) required to cool engine 2. As shown in FIG. 3, as the coolant Reynolds number is increased, the power of motor-driven pump 8 is accordingly increased. Then, as the fan velocity is increased, the fan power, i.e., the power required to rotate fan motor 12 is increased. A sum of the pump power and the fan power, i.e., the power of rotational drive motor 12, viz., the power required to cool engine 2 is reduced when the coolant Reynolds number indicate 1800 through 6000, as shown in FIG. 3. The region in which the power required to cool engine 2 becomes lower, as described above, ranges over a transition range between a laminar flow and a turbulence flow of the coolant circulated into tubes 6 of radiator 7 and over a part of the turbulence flow range which is placed in the vicinity to the transition range. In such a radiator as described above, motor-driven pump 8 is controlled so that the Reynolds number falls in the region of 1800 through 6000 during the high load state and fan 11 is controlled to fall in a wind velocity range of 2.8 m/sec to 3.3 m/sec. Hence, the electrical power required to cool the engine can be suppressed to be low. At this time, a most favorable fuel economy can be achieved.

It is noted that a factor to improve the performance of radiator 7 includes an improvement in a performance of a fin formed on an outside of each tube 6. When the coolant Reynolds number is reduced and the coolant does not appear the turbulence flow, the cooling performance of the coolant is reduced extremely. Hence, it is important to use the turbulence state coolant as desirable as possible.

An optimum design to cooling system 1 from a viewpoint of an energy will be described.

Which balance of the coolant temperature and the fan (wind) quantity is optimally taken in the engine cooling by means of the radiator will be reviewed by calculating the energy required to cool engine 2.

(Contribution rate of a water quantity and wind quantity in a radiator single body)

A radiation quantity (heat dissipation) of radiator can be determined using the following equation (1): That is to say, $Q=\kappa/(\alpha w\cdot Aw/A)+d/(\lambda t\cdot Aw/A)+1/\alpha a\cdot\eta a)$ - - - (2).

$$1/\kappa=11(\%)+0.1(\%)+88.9(\%) \quad (3)$$

Figure 4:
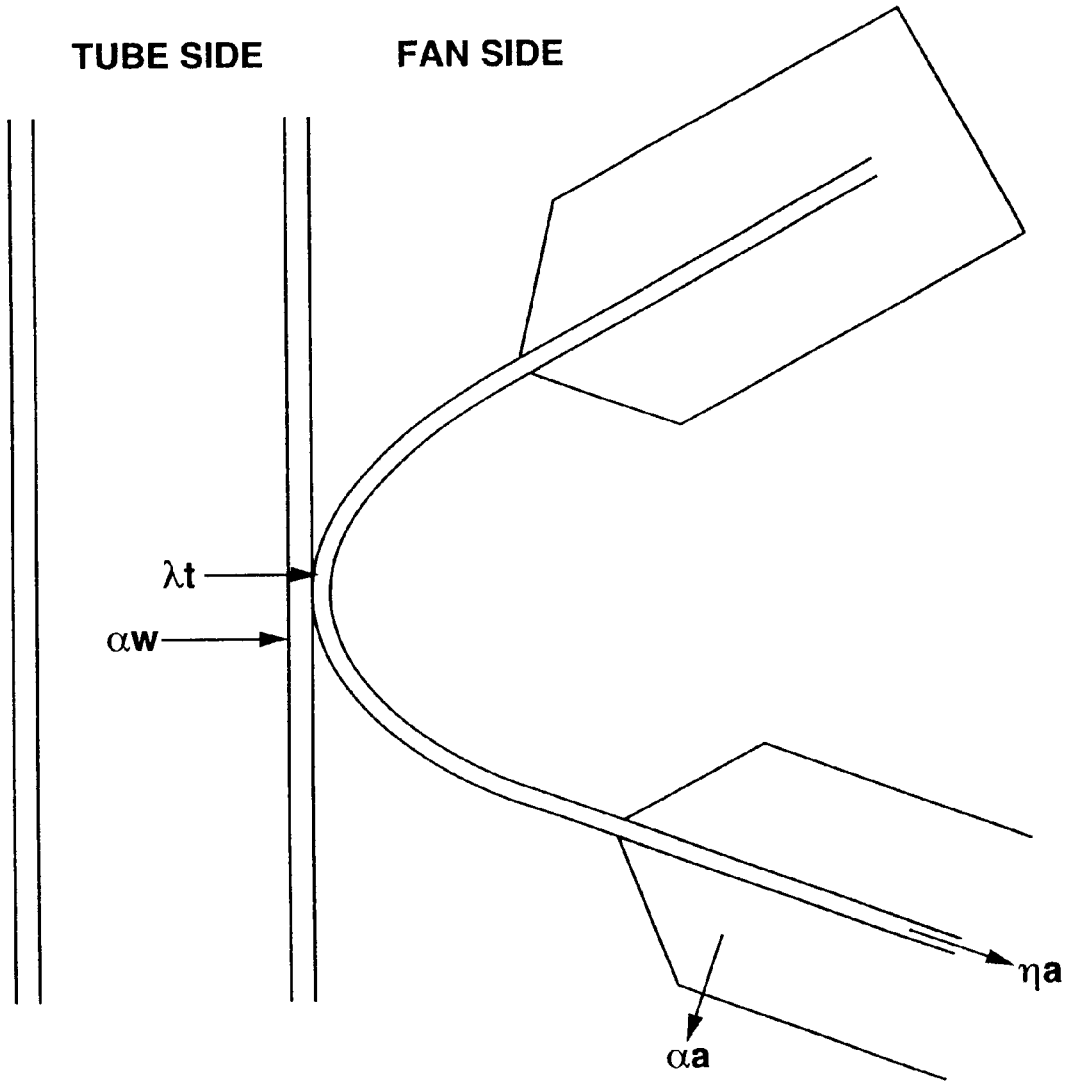
FIG. 4 is an explanatory view representing a coolant flowing within one of tubes and a heat transmission system.
Figure 8:
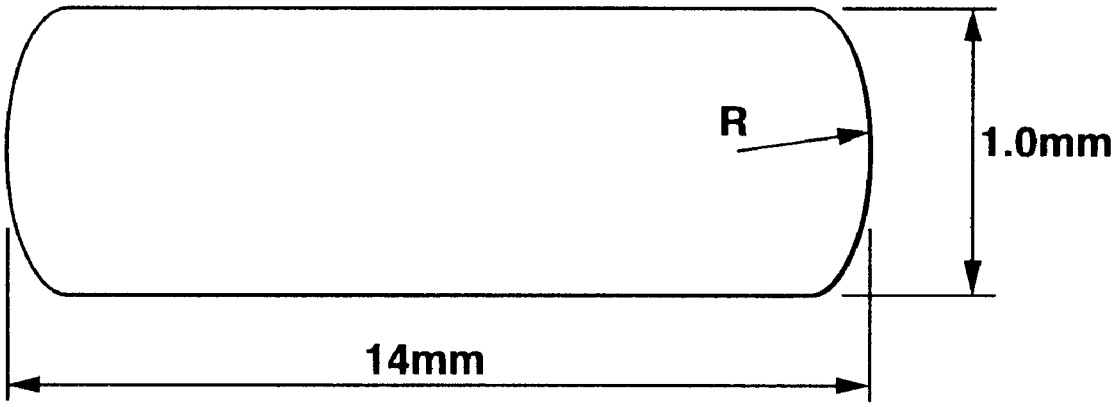
FIG. 8 is an explanatory view representing form and dimension of each tube arranged in a, so-called, lateral flow type radiator.

As shown in FIG. 4, $\lambda t$ denotes a tube conductivity (W/mK), $\alpha a$ denotes an aerial side thermal transmission rate ($W/m^2K$), $\alpha w$ denotes a coolant thermal transmission rate, $\eta a$ denotes a fin overall efficiency (%), Aw denotes the coolant radiation area ($mm^2$), A denotes an aerial side radiation area ($mm^2$), and d denotes a tube plate thickness (mm). In addition, an equation (3) denotes a contribution rate for each term in equation (2). The equation (3) was derived from the following condition using the longitudinal flow type radiator having a lateral dimension of the core portion (radiator portion) being 691.5 mm, the longitudinal dimension of 360 mm, the depth dimension of 16 mm, and 76 tubes as shown in FIG. 8. That is to say, the condition was that the flow quantity of the coolant was 40 liters/second (Reynolds number was 3500) and the wind velocity was 3 m/sec.

Figure 5:
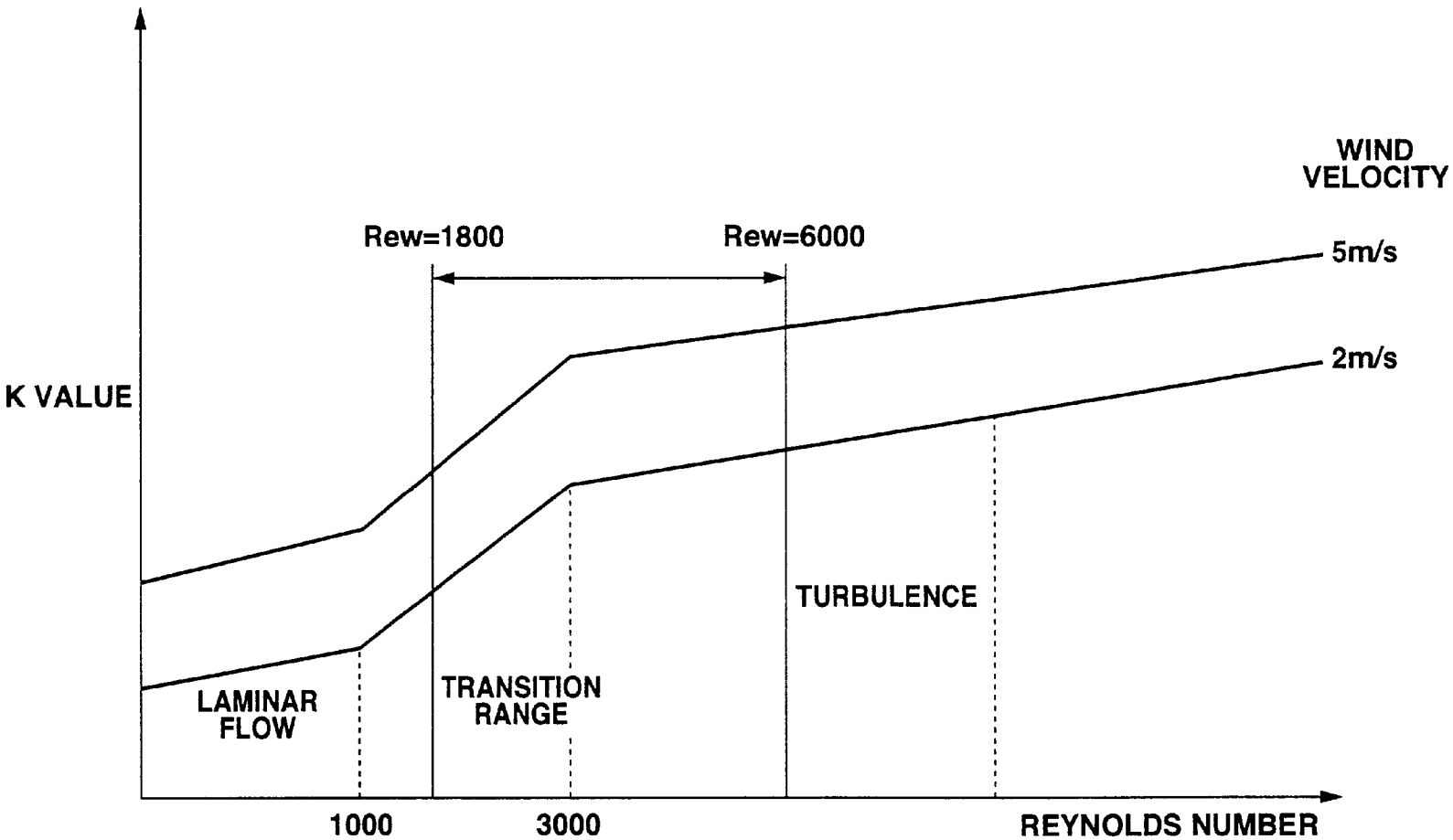
FIG. 5 is a characteristic graph representing a relationship from among a K value, coolant Reynolds number, and a fan wind velocity.

The relationship between K value and coolant Reynolds number is shown in the graph of FIG. 5. FIG. 5 also shows a stream state of the coolant varied along with the coolant Reynolds number. It will be appreciated from FIG. 5 that a region shown in FIG. 3 and in which the power required to cool engine 2 is lowered, viz., the region in which the Reynolds number of the coolant within tubes 6 of radiator 7 indicates from 1800 to 6000 ranges over a transition range of the stream state of the coolant circulated within tubes 6 of radiator 7 between a turbulence state and a laminar state and over the turbulence area adjacent to the transition range. The contribution rates of the coolant and the air to the performance of the radiator are, as shown in equation (3), such that the contribution rate of the air thereto (88.9%) is larger than that of the coolant (11%). Hence, in a case where the required heat dissipation is increased, the engine can be cooled with a less power under a state wherein the quantity of coolant is fixed and the fan wind quantity is increased than that under any other state. The Reynolds number of the coolant is determined in the range optimizing the power required to cool engine 2. An optimum control in any one of various forms of radiators can be achieved. It is noted that, since the coolant is circulated within tubes of each of the various forms of radiators, the present invention is applicable to the cooling system for the water-cooled engine including every form of the radiator.

That is to say, since Reynolds number Re is expressed as $DaG/\mu$ (equivalent diameter×mass velocity/viscous coefficient), wherein Da denotes the equivalent diameter which is a multiplication of a value of a water passing cross sectional area of each tube divided by an inner peripheral length with a value of 4, the mass velocity of the coolant is G, and viscous coefficient is $\mu$, the flow becomes analogous dynamically and the thermal transmission rate becomes equal if this Reynolds number Re is the same. Hence, it becomes possible to minimize the power (the sum of the fan power and the pump power) required to cool engine 2 by controlling the Reynolds number of the coolant circulated through each kind of radiators 7 to fall into the range of 1800 through 6000. Consequently, the burden on the power can be relieved and the remarkable improvement in the fuel economy of engine 2 can be achieved.

(Optimum Energy Balance of Radiator Cooling)

Figure 6:
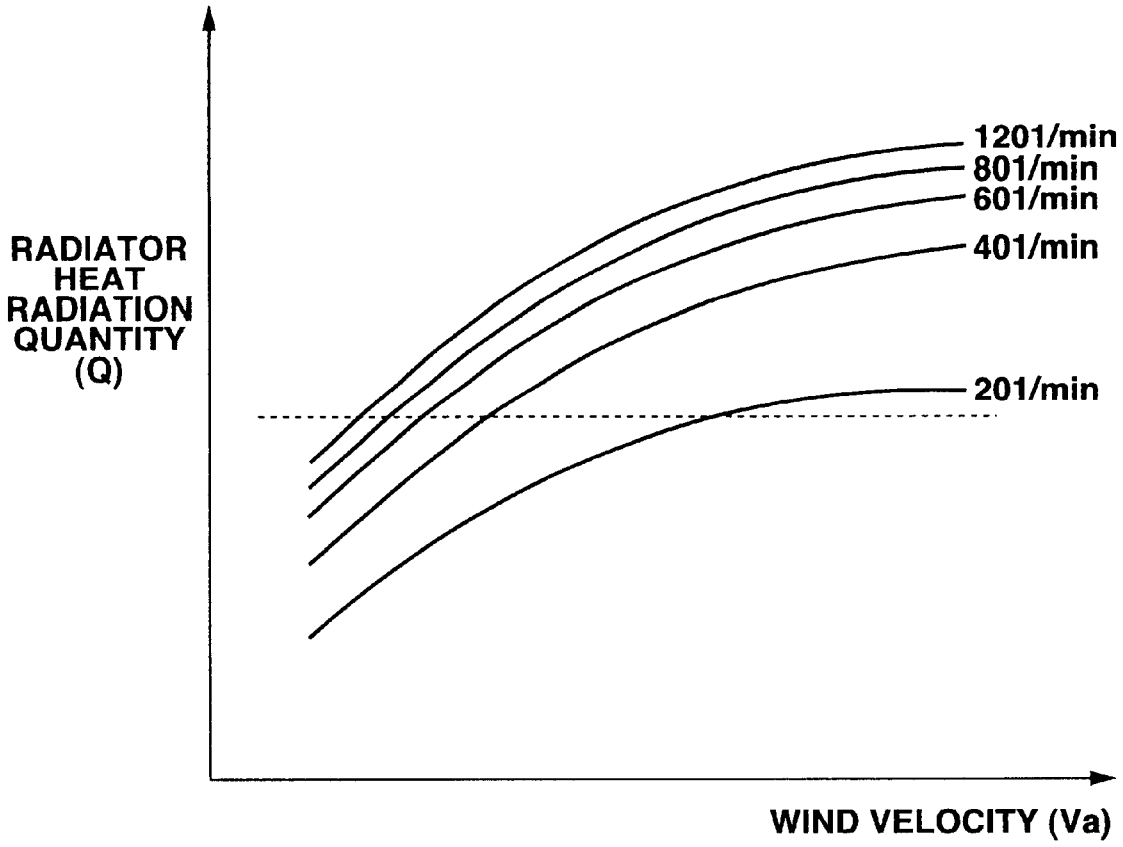
FIG. 6 is a characteristic graph representing a relationship between a radiator radiation quantity (Q) and fan wind velocity (Va).

Next, FIG. 6 shows the relationship from among the radiator performance (radiator heat dissipation (radiation quantity) Q), the wind quantity (wind velocity Va), and the coolant flow quantity (Gw) using the longitudinal flow type radiator having the structure of 691.5 mm lateral dimension of the core portion, 360 mm the longitudinal dimension, and 16 mm depth dimension. The longitudinal axis of FIG. 6 is radiator heat dissipation and the lateral axis thereof is the wind velocity. Table 1 represents a combination between wind velocity (Va) and coolant flow quantity (Gw) in order to produce the same performance (radiator heat dissipation Q) using the same radiator. As shown in Table 1, it is possible to select properly the combination of wind velocity (Va) and coolant flow quantity (Gw) in order to output the same radiator heat dissipation (for example, $3.4\times10^4$ W).

(Energy Required to Cool Engine 4)

Next, when a comparison between each required energy for the coolant and for the air is made by using a theoretical power expressed by the following equation (4), results shown in Table 2 are given.

$P=\rho gQH$ - - - (4), wherein P denotes a power (W), $\rho$ denotes a fluid density ($Kg/m^3$), g denotes a gravitational acceleration ($m/s^2$), Q denotes a flow quantity ($m^3/s$), and H denotes a pressure difference (m). In addition, Table 2 shows experimental values of the radiator fan and indicating the efficiency of motor-driven pump 8.

It can be confirmed from Table 2 that when a total sum of the required power is 280 W at minimum and the Reynolds number at the present time of 280 W is 2600 which falls in the range of the Reynolds number (1800 through 6000) enough to make the required power cool the engine. On the other hand, although the contribution rate of the air to the performance of the radiator is large, the contribution rate of the coolant to the performance of the radiator is small. Hence, it is less power required to cool the engine with small flow quantity of the coolant and large quantity of the fan wind quantity, in terms of energy. However, if the flow quantity of the coolant becomes less to such a degree for the coolant on tubes to indicate the laminar flow, the performance on the coolant becomes extremely reduced. This is not preferable for the cooling system for the water-cooled engine.

(Control Method of the First Embodiment)

Figure 7:
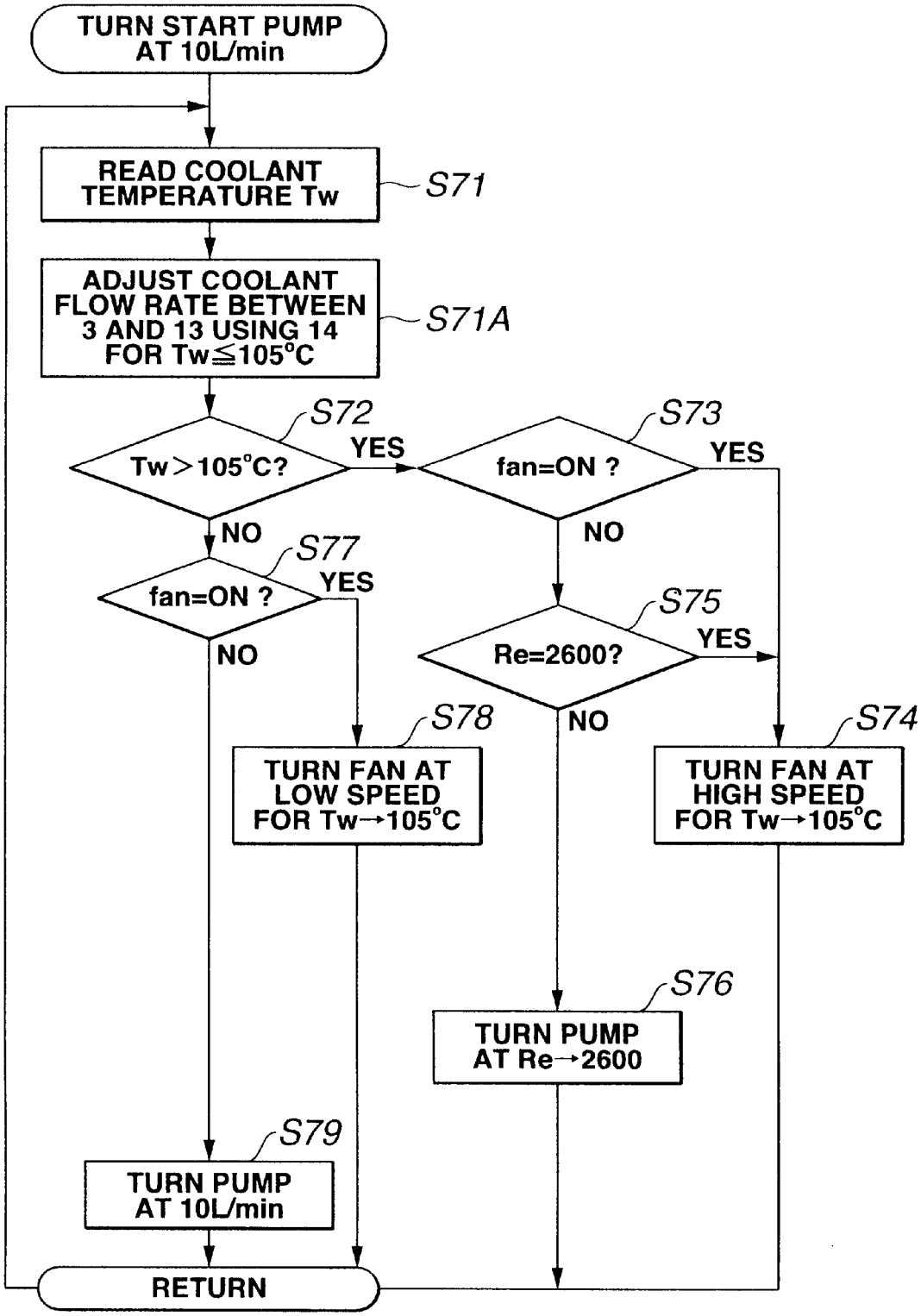
FIG. 7 is an operational flowchart representing a control procedure executed in a controller shown in FIGS. 1 and 2.

Control method and operation of cooling system 1 for water-cooled engine 2 will be described with reference to the flowchart of FIG. 7. It is noted that, in the first embodiment, a memory portion (for example, ROM) of controller 15 stores an output data on motor-driven pump 8 corresponding to the tube flow velocity in the optimum range shown in FIG. 3 and the output data on rotational drive motor 12 corresponding to the fan wind velocity. These output data are read from the memory portion at any time together with the variation in detected temperature of the coolant. When vehicular engine 2 is started, motor-driven pump 8 is started to move at a predetermined low flow quantity of, for example, about 10 L/min. This predetermined low flow quantity corresponds to a relatively low flow quantity for the coolant within engine 2 not to generate a local boiling. In this embodiment, the coolant flows into coolant circulation passage 23 in the order of cylinder head 21 and cylinder block 22. The temperature sensor 9 detects coolant temperature Tw within coolant circulation flow passage 23 of cylinder block 22 (step S71). The thermostat 14 is circulated so as to bypass radiator 7 by causing the coolant to flow through bypass circuit 13 to bypass radiator 7 until the circulated coolant temperature reaches to 100° C., as shown in FIG. 2.

Along with the operation of engine 2 when the temperature of the coolant derived from cylinder block 23 is raised up to 100° C., thermostat 14 is adjusted to gradually open the coolant circulation tube 3 and is adjusted to completely open coolant circulation passage 3 while completely closing coolant bypass circuit 13 when temperature Tw of coolant is equal to or higher than 105° C. Thus, the coolant introduced from upper header 4 is passed through tubes 6 into lower header 5, as shown in arrow marks shown in FIG. 1 (step S71A).

At this time, in a case where the detected temperature of temperature sensor 9 does not reach to 105° C., rotational drive motor 12 is not operated and fan 11 is not rotated. The coolant passing through tube 6 carries out only a thermal exchange to an external running air. The coolant outputted from header 5 is supplied to the coolant circulation passage of cylinder head 21 via coolant circuit 10 via motor-driven pump 8. It is noted that the temperature of the coolant supplied to cylinder head 21 is set to, for example, become about 85° C.

The coolant introduced from cylinder head 21 cools cylinder head 21, cools cylinder block 22, and is introduced to coolant circuit 3. Next, at a step S72, controller 15 determines whether the coolant temperature is higher than 105° C. Consequently, if the coolant temperature Tw is determined to be higher than 105° C. (yes), controller 15 determines whether fan 11 is rotationally driven. If fan 11 is rotationally driven, controller 15 outputs a revolution speed control signal Sr to the rotational drive motor 12 so that the wind quantity of fan 11 is increased and the coolant temperature indicates 105° C. Accordingly, the rotation velocity of rotational drive motor 12 becomes fast and the wind quantity of fan 11 is properly increased, at a step S74. Thereafter, the temperature detection is continued to be carried out at a step S71.

On the other hand, if fan 11 is not rotationally driven (No at step S73), controller 15 determines whether the coolant Reynolds number of tubes 6 of radiator 7 indicates 2600. In addition, if the coolant Reynolds number is not 2600 at step S75 (No), controller 15 outputs the flow velocity control signal Sv to motor-driven pump 8 so that the coolant Reynolds number indicates 2600 (step S76). At step S71, controller 15 continues the temperature detection at step S71. If controller 15 determines that the coolant temperature is equal to or lower than 105° C. at step S72, the routine goes to a step S77. At step S77, controller 15 determines whether fan 11 is rotationally driven. If fan 11 is rotationally driven (Yes), the controller 15 outputs revolution speed control signal Sr to rotational drive motor 12 at a step S78. The controller 15 outputs revolution speed control signal Sr to rotational drive motor 12 so that the detection temperature of the coolant indicates 105° C. At step S78, controller 15 controls the revolution of fan 11 to suppress the revolution thereof and continues the temperature detection of the coolant at step S71.

If controller 15 determines that fan 11 is not rotationally driven at step S77 (No), controller 15 continues operation of motor-driven pump 8 maintaining the flow quantity of 10 liter/min at a step S79 and continues the detection of the coolant temperature at step S71.

If such a control procedure as described above is continued and the detection temperature by means of temperature sensor 9 is equal to or above 105° C. which is a predetermined target temperature, the stream (flow) state of the coolant circulated within tubes 6 of radiator 7 falls within the region over the transition range between the laminar flow and the turbulence flow as shown in FIG. 5 or over the part of the turbulence range adjacent to the transition range. Motor-driven pump 8 is driven so that the coolant is circulated by a predetermined flow quantity. In general, in each of the automotive vehicular engine, in order to quicken the warm-up of the engine during a cold start, such a control as to increase fuel injection quantity during an engine idling is carried out until coolant temperature Tw becomes a predetermined temperature. Hence, as this control time duration becomes short, viz., if coolant temperature Tw becomes equal to or higher than a predetermined coolant temperature (for example, 80° C.), the fuel consumption becomes improved. In this embodiment, since the extra heat radiation is prevented from occurring by suppressing the coolant flow quantity to the predetermined relatively low flow quantity (for example, 10 liters/minute) such as not for the engine to generate the local boiling until engine 2 is started and coolant temperature Tw exceeds 105° C., the coolant temperature Tw can quickly be raised. Hence, the fuel consumption can be improved by shortening the control time duration of the increase in quantity of the fuel injection quantity.

In the first embodiment, under a state wherein the high load is imposed on the engine, the reduction of the power due to the lowered flow quantity by means of motor-driven pump 8 under the high engine load can be achieved. At the same time, an improvement in a flow passage through which the coolant is caused to flow and a temperature difference between the inlet and the outlet of radiator 7 generated due to the lowered flow quantity can achieve a low coolant temperature control (about 85° C.) for cylinder head 21 to prevent the knocking and a high coolant temperature (about 105° C.) control for cylinder block 22 to reduce a friction loss such as an oil friction loss.

In addition, motor-driven pump 8 is used so that the flow quantity of the coolant can be controlled with a good response characteristic to an optimum quantity and the power loss can be reduced.

If cooling system 1 in which the above-described control procedure is carried out is applied to the vehicle, the lowered flow quantity merely by means of motor-driven pump 8 can achieve an improvement in the fuel economy by about 9% in the case of a mini-sized vehicle (displacement is equal to or lower than 660 milliliter) at a constant speed run of, for example, 60 Km/h and the improvement in the fuel economy by about 2% in the case of the automotive vehicle having the displacement of 1.8 liters during the constant speed run of 60 Km/h.

(Second Embodiment)

Figure 9:
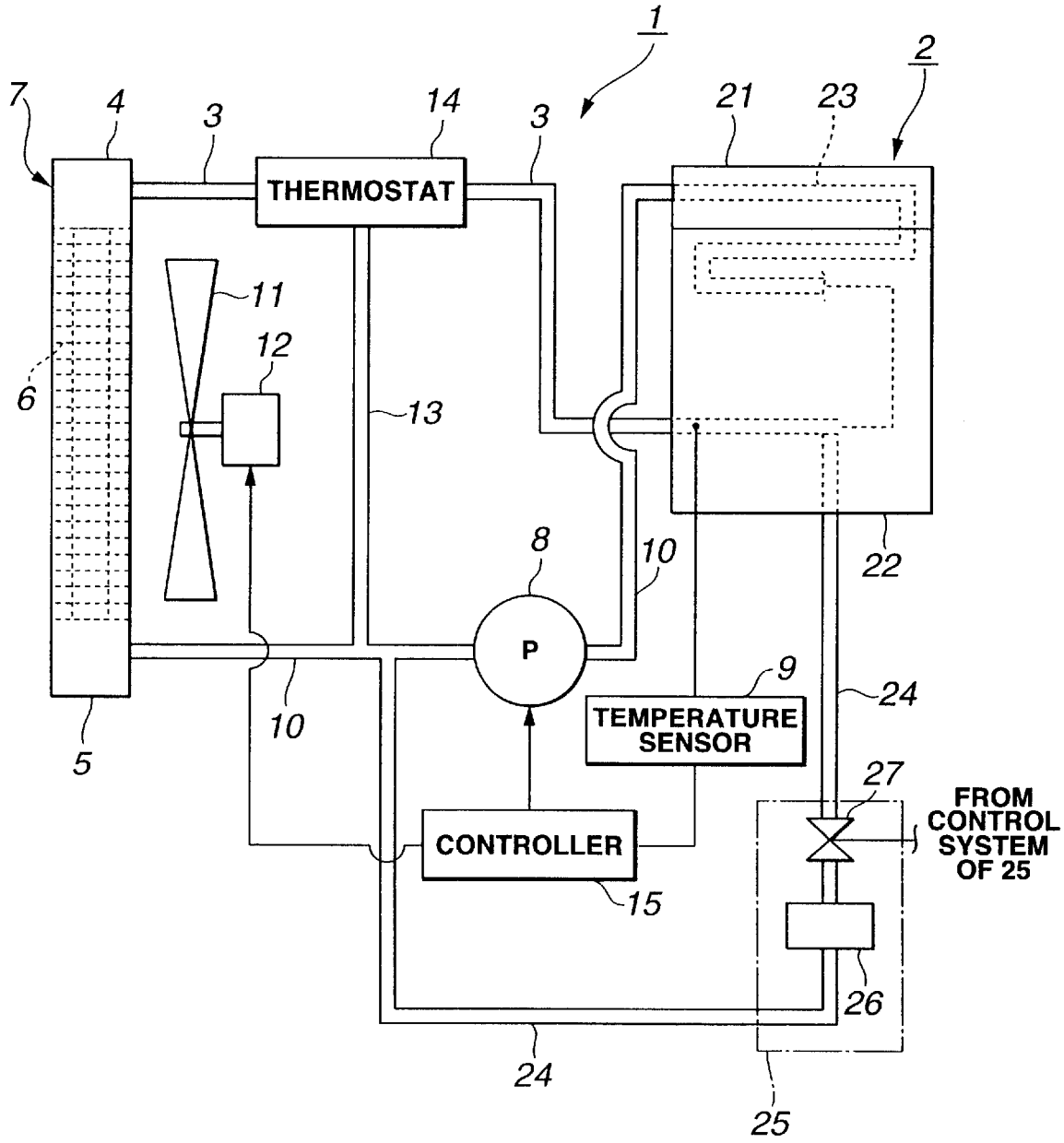
FIG. 9 is a schematic block diagram of the water-cooled internal combustion engine to which the cooling system in a second preferred embodiment according to the present invention is applicable.

FIG. 9 shows an explanatory view of a second preferred embodiment of the cooling system for the water-cooled engine according to the present invention. The cooling system in the second embodiment has the structure such that a hot water introduced from the cylinder block is circulated through the heater core of an air conditioner. It is noted that, in the cooling system in the second embodiment, the same reference numerals as those in the first embodiment, the same reference numerals as those described in the first embodiment corresponds to like elements described in the first embodiment. As shown in FIG. 9, cooling system 1 in the second embodiment includes: radiator 7 which serves as the heat exchanger in which the coolant flowing out via coolant circuit 3 is circulated into tubes 6 interposed between headers 4 and 5; motor-driven pump 8 driven independently of engine 2 and in which the coolant is circulated between engine 2 and radiator 7; temperature sensor 9 as the temperature detecting device for detecting the coolant temperature within engine 2; coolant circuit 10 in a midway through which motor-driven pump 8 is interposed for circulating the coolant from radiator 7 to engine 2; rotational drive motor 12 having fan 11 in which the wind supply (ventilation) is carried out for tubes 6 of radiator 7; thermostat (valve) 14 interposed in a midway through coolant circuit (coolant circulation tube) 3 for distributing the coolant supplied from engine 2 toward radiator 6 into bypass circuit 13 circulated toward the suction side of motor-driven pump 8 in accordance with coolant temperature Tw; and controller 15 which controls the drive output of motor-driven pump 8 and the revolution speed of rotational drive motor (fan motor) 12 on the basis of the detected value detected by temperature sensor 9. In addition, a heater core 26 of an air conditioner 25 is interposed in a midway through a hot water circulation passage 24 introduced from engine 2, viz., from coolant circulation passage 23 of engine 2.

In the second embodiment, coolant circulation passage 23 to communicate the cylinder head 21 with cylinder block 22 in engine 2 is formed. The above-described coolant circuit 10 is communicated with the end of the cylinder head of coolant circulation passage 23.

In addition, coolant circulation passage 23 formed in cylinder block 22 is branched and connected to coolant circuit 10 at the upstream side of motor-driven pump 8. The host water circulation passage 24 is communicated with coolant circulation passage 23. The heater core 26 is interposed in the midway through hot water circulation passage 24 so that the hot water (engine coolant) passes within heater core 26. An electromagnetic valve 27 which carries out an adjustment of the flow quantity of the hot water is interposed in hot water circulation passage 24 located at the upstream side of heater core 26. A valve opening degree of electromagnetic valve 27 (valve closure and opening) is properly adjusted by a control system of air conditioner 25.

The above-described coolant circuit 3 is communicated with the end of cylinder block 22 of coolant circulation passage 23. That is to say, the coolant supplied by means of motor-driven pump 8 is set in such a way that the coolant enters cylinder head 21 and comes out through cylinder block 22. The radiator 7, in this embodiment, is constituted by the, so-called, longitudinal flow type structure having headers 4 and 5 vertically spaced apart from each other and a multiple number of tubes 6 juxtaposed to each other between headers 4 and 5.

In the second embodiment, coolant circuit 3 is connected to the end of coolant circulation passage 23 of cylinder block 22. In the second embodiment, thermostat 14 interposed in the midway through coolant circuit 3 is set to gradually open coolant circuit (coolant circulation passage) 3 connecting between that on cylinder block 22 and upper header 4 when the coolant temperature Tw is equal to or higher than, for example, 100° C. and completely open coolant circulation tube 3 while completely closing coolant circulation tube 3 when temperature Tw is equal to or higher than 105° C. Thermostat 14 is set to cause the coolant to completely flow into bypass circuit 13 when temperature Tw is below 100° C. In addition, rotational drive motor 12 on which fan 11 to ventilate tubes 6 of radiator 7 is mounted is connected to controller 15. The revolution speed is controlled on the basis of revolution speed control signal Sr from controller 15. It is noted that controller 15 controls rotational drive motor 12 so that the temperature of the coolant introduced from cylinder block 22 indicates 105° C. The motor-driven pump 8 can vary the flow velocity of the coolant on the basis of flow velocity control signal Sv from controller 15.

The temperature sensor 9 is arranged to enable the temperature detection placed in the vicinity to a final end portion at coolant circulation passage 23 of cylinder block 22.

In the second embodiment, controller 15 controls the flow quantity generated by motor-driven pump 8, particularly the coolant Reynolds number of radiator 7 and the revolution speed of rotational drive motor 12 of fan 11. By specifying the state of the coolant circulated into tubes 6 of radiator 7 during the high load state, the reduction of the power loss can be achieved. It becomes possible to achieve a remarkable improvement in fuel economy.

In the second embodiment, the hot water set to the approximately constant temperature of 105° C. derived via hot water circulation passage 24 from coolant circulation passage 23 of cylinder block 22 is set to be circulated through heater core 26 of air conditioner 25 and the circulated flow quantity can be controlled by means of electromagnetic valve 27. Since, in the air conditioner, the heat exchange quantity to the air can be determined according to a gross thermal quantity and aerial wind quantity per unit time of heater core 26, controls over hot water flow quantity and wind quantity permit a blowing-out (blast) temperature of air conditioner 25 to be set.

The hot water flow quantity and wind quantity by means of electromagnetic valve 27 are controlled so that a setting of blast temperature of air conditioner 25 can be achieved. Furthermore, the relationship between the fuel economy and fluid flow quantity in the case of heater core 26 is the same as in the case of radiator 7. That is to say, in order to fall the stream state of the coolant within its tube into the region of the transition range between the laminar state and the turbulence state or of the part of the turbulence state placed ion the vicinity to the laminar state, viz., in order to fall the Reynolds number into the range of 1800 to 6000, preferably in a range about 2600, motor-driven pump 8 and electromagnetic valve 27 are controlled to provide the predetermined flow quantity of the coolant. Thus, an efficient thermal exchange can be achieved thereat. In addition, such an air mixing door as used to adjust a mixture of cooled air and hot air can be omitted and a small sizing of air conditioner 25 can be achieved.

(Control Method of Second Embodiment)

Figure 10:
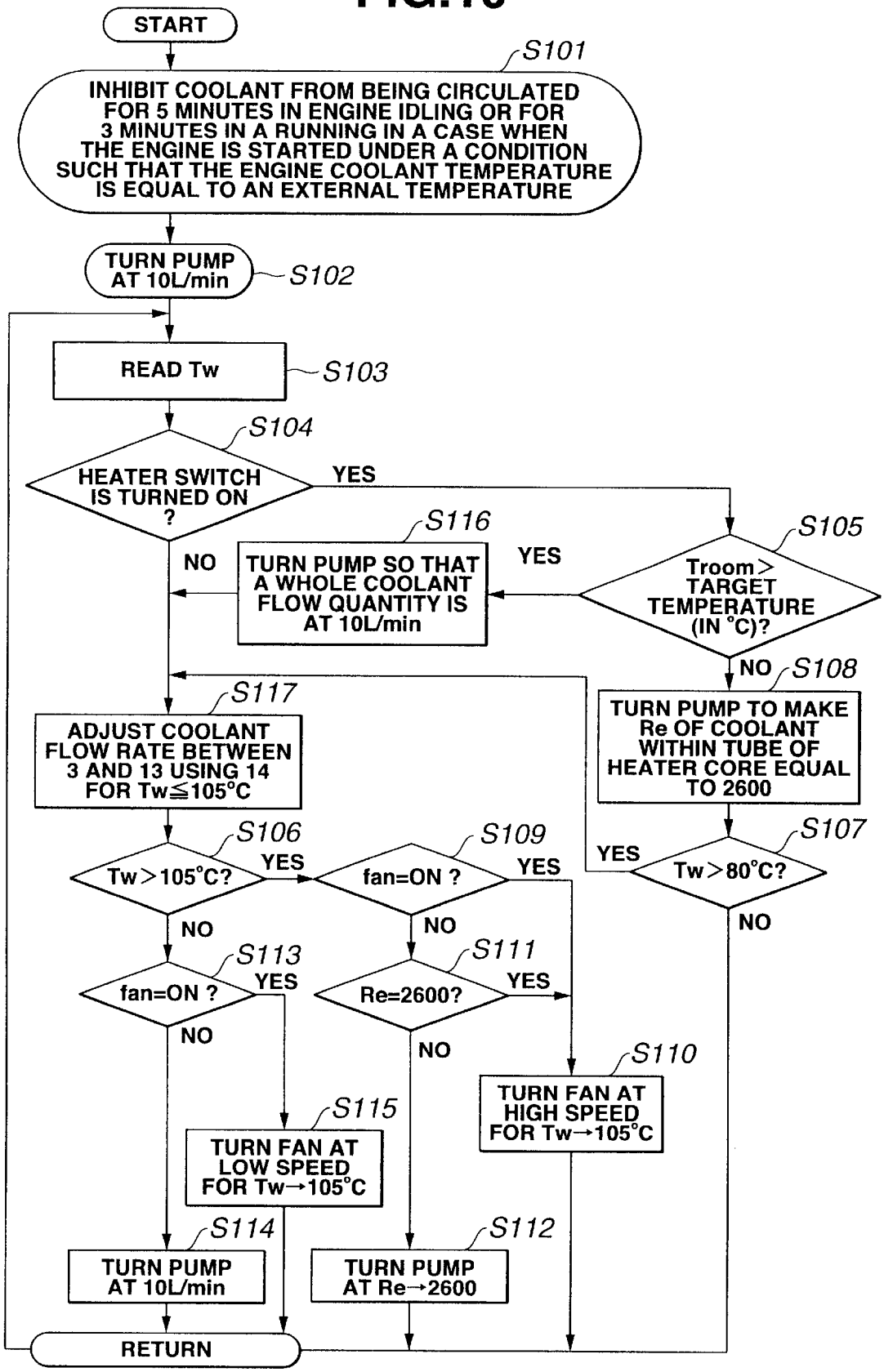
FIG. 10 is an operational flowchart representing a control procedure executed by the controller of the cooling system in a second preferred embodiment according to the present invention.

Control method applicable to cooling system 1 for water-cooled engine in the second embodiment will be described with reference to an operational flowchart shown in FIG. 10.

It is noted that, in second embodiment, when coolant temperature within coolant circulation passage 23 of cylinder block 22 is equal to an external temperature (ambient temperature of the vehicle) at a time at which the engine is started, electromagnetically operated (motor-driven) pump 8 is not operated (inhibited from being turned on) for five minutes in the case of an engine idling or for three minutes in the case of a vehicular start to run (step S101). Thereafter, after a predetermined period of time (five minutes described above or three minutes described above) is elapsed, motor-driven pump 8 is operated at the flow quantity of 10 L/min (step S102). It is noted that the routine shown in FIG. 10 is started upon the turn on of a vehicular ignition switch and the execution at step S101 may be omitted and the routine shown in FIG. 10 may directly go to a step S103. The coolant flows into coolant circulation passage 23 in such an order as cylinder head 21 and cylinder block 22. Controller 15 starts to read coolant temperature Tw within coolant circulation passage 23 of cylinder block 22 (and read a room temperature Troom and a target temperature of a passenger compartment of the vehicle) (step S103). The thermostat 14 is set to cause the coolant to flow into bypass circuit 13 so as to bypass radiator 7 until the coolant temperature circulated has reached to 100° C. When the temperature of the coolant derived from cylinder block 23 is raised up to 100° C., thermostat 14 is started to close bypass circuit 13 and open coolant circuit 3 so that the coolant is circulated toward header 4 of radiator 7. When the coolant temperature Tw is equal to or higher than 105° C., thermostat 14 completely close the bypass circuit and completely opens the coolant circulation tube 3 so that the whole coolant is circulated through tubes 6 of radiator 7. That is to say, the coolant introduced from header 4 reaches to header 5 through tubes 6.

At this time, in a case where the detected temperature by means of temperature sensor 9 does not yet reach to 105° C. which is a predetermined target temperature, rotational drive motor 12 is not operated and fan 11 is not rotated. The coolant passing through tubes 6 is only to perform the thermal exchange with the external air during the vehicular run. The coolant derived from header 5 is outputted to coolant circulation passage 23 of cylinder head 21 via motor-driven pump 8. It is noted that the temperature of the coolant which reaches to cylinder head 21 is set to, for example, 85° C. The coolant introduced from cylinder head 21 cools cylinder head 21, cools cylinder block 22, and is introduced into coolant circuit 3 so that the coolant is circulated through the above-described route. Next, controller 15 determines whether a heater is being used at a step S104. It is noted that a meaning that the heater is being used is either a state in which an actual room temperature is lower than a set temperature (target temperature) in an automatic air conditioner of the vehicle or a state in which a heater switch of a manual air conditioner of the vehicle is in a turn on state.

If the heater is being used (Yes at step S104), the routine goes to a step S105. At step S105, controller 15 determines if temperature value of the passenger compartment is higher than the target temperature (set temperature). If Troom >target temperature (Yes) at step S105, the routine goes to a step S116. At step S116, controller 15 commands the motor-driven pump 8 to turn so that the whole coolant flow quantity indicates 10 liters/minute (L/min.). Then, the routine goes to a step S117. At step S117, controller 15 commands thermostat valve 14 to adjust the coolant flow quantity rate between the passages 3 and 13 so that the temperature Tw indicates a value equal to or below 105° C. At the next step S106, controller 15 determines if temperature Tw of the coolant is higher than 105° C. If Troom≦target temperature (No) at step S105, the routine goes to a step S108. At step S108, controller 15 commands the motor-driven pump 8 to turn the pump so that the Reynolds number (Re) of the coolant within the tube of heater core 26 is made equal to 2600. Then, the routine goes to a step S107. At step S107, controller 15 determines if coolant temperature Tw is higher than 80° C. If Tw is higher than 80° C. at step S107 (Yes), the routine goes to step S117. If Tw≦80° C. (No) at step S107, the routine is repeated and jumps to step S103.

If Tw>105° C. (Yes) at step S106, the routine goes to a step S109. If Tw≦105° C. (No) at step S106, the routine goes to a step S113. Controller 15 determines, at step S109, whether fan 11 is operated. If fan 11 is determined to be operated (Yes at step S109), controller 15 outputs rotation speed control signal Sr to rotational drive motor 12 to increase the rotation speed of fan motor 12 to increase the rotational speed of fan motor 12 so that the coolant within coolant circulation passage 23 of cylinder block 22 indicates 105° C. at a step S110. At a step S111, if fan 11 is not operated at step S109 (No), controller 15 carries out the determination of whether the coolant Reynolds number at tubes 6 of radiator 7 indicates 2600. At a step S111, if the coolant Reynolds number is 2600 (Yes), the rotation speed of fan 11 is increased so that the coolant temperature within coolant circulation passage 23 of cylinder block 22 indicates 105° C. at step S110. If, at step S111, Re=2600 (Yes), controller 15 controls the increase in the rotation speed of fan 11 so that the coolant temperature within coolant circulation passage 23 of cylinder block 22 indicates 105° C. (step S110). If, at step S111, Re≠2600 (No), controller 15 controls motor-driven pump 8 so that the coolant Reynolds number indicates 2600 at a step S112. The controller 15 continues the detection of the coolant by means of temperature sensor 9. On the other hand, if the coolant temperature is detected to be equal to or lower than 105° C. at a step S106 (No), controller 15 determines if fan 11 is operated at step S113.

If fan 11 is not operated (No) at step S113, controller 15 drives motor-driven pump 8 at 10 L/min. at step S114 and continues to detect the coolant temperature. In addition, if fan 11 is operated (Yes at step S113), controller 15 controls the rotation speed of fan 11 so that the coolant temperature within coolant circulation passage 23 of cylinder block 22 indicates 105° C. and the rotation speed of fan 11 is reduced to rotate at a slow speed at step S115 and the detection of the coolant temperature is continued (the routine returns to step S103). It is noted that, in the second embodiment, when the coolant temperature detected by temperature sensor 9 is lower than 80° C., controller 15 controls the drive of the motor-driven pump 8 to circulate the coolant at a relatively small flow quantity of 10 liters/min. Hence, the extra heat radiation of the coolant is suppressed, the coolant temperature is quickly raised, the control time duration of the increase in quantity of the fuel injection quantity during the engine idling which is carried out for the coolant temperature to become equal to or higher than the predetermined coolant temperature (80° C.) and the fuel economy can be achieved.

When the coolant temperature by means of temperature sensor 9 is equal to or above 105° C. which is the predetermined target temperature, in the above-described control procedure by controller 15, the stream (flow) state of the coolant circulated within tubes 6 of radiator 7 falls within the transition range between the laminar flow and the turbulence flow or falls within the turbulence flow range placed in the proximity to this transition range, as shown in FIG. 5. The drive of motor-driven pump 8 can simultaneously be carried out so that the coolant is circulated in water-cooled engine 2 and radiator 7 by the predetermined flow quantity. In the second embodiment, the reduction of the power loss due to the reduced flow quantity of the coolant by means of motor-driven pump 8 can be achieved even under the high load imposed on engine 2. The temperature difference in the entrance and exit of radiator 7 and the improvement in the flow quantity by which the coolant is caused to flow from cylinder head 21 can control the coolant at the low coolant temperature (about 85° C.) so as to prevent an engine knocking from being occurred at cylinder head 21 and can control the coolant at the high coolant temperature so as to reduce the friction loss due to an oil friction loss at cylinder block 22. In addition, the use of the motor-driven pump 8 permits an optimum flow quantity control of the coolant so that the power loss of the motor-driven pump itself can be reduced.

When cooling system 1 which carries out the above-described control procedure is applied to the vehicle, a mere reduction in the flow quantity of the coolant by means of the motor-driven pump 8 can achieve about 9% of a fuel economy in the case of a mini-sized vehicle and about 2% of the fuel economy in the case of the automotive vehicle having an engine displacement of 1.8 liters during a constant speed run at, for example, 60 Km/h. Then, the high temperature cylinder block 22 can achieve about 1% of the fuel economy in the case of the mini-sized vehicle and about 3% of the fuel economy in the case of the 1.8 liter vehicle during the constant speed run of 60 Km/h.

In addition, since, in the second embodiment, the coolant (hot water) passed through cylinder block 22 is circulated through heater core 26 of air conditioner 25, such an air mixing door as required in the normally available air conditioner can be omitted, a small sizing of air conditioner 25 can be achieved, and a temperature rise in heater core 26 can quickly be made.

As described above, cooling system 1 in each of the first and second embodiments has been described. The present invention is not limited to this. Various modifications in design can be made without departing from the sprit of the present invention.

For example, in the above-described first and second embodiments, motor-driven pump 8 is controlled so that the coolant Reynolds number of tubes 6 indicates 2600. However, the Reynolds number is not limited to 2600 and the flow quantity of the coolant flowing within tubes 6 may correspond to the region of 1800 through 6000 of the Reynolds number. In addition, in each of the first and second embodiments, cooling system 1 according to the present invention is applicable to radiator 7 having the structure of, so-called, longitudinal flow type) in which headers 4 and 5 are vertically arranged. However, the present invention is applicable to the radiator having another structure in which both headers are laterally arranged (so-called, a lateral flow type).

Table 3 represents the relationship from among the radiator performance (radiator radiation quantity Q), the wind velocity (wind velocity Va), and the coolant flow quantity (Gw) when 39 tubes (each tube is shown in FIG. 8) are arranged in the radiator of the lateral flow type and this radiator of the lateral flow type is used.

Table 3 shows a combination of the wind velocity (Va) and the coolant flow quantity (Gw) to exhibit the same performance (radiator heat dissipation (radiator quantity) (Q)) with the same radiator. As shown in Table 3, it is possible to properly select the wind velocity and the coolant flow quantity in order to exhibit the same radiation quantity (heat dissipation) (Q) of $3.4\times10^4$ W.

In addition, Table 4 represents experimental values of the efficiencies of the fan for the lateral flow type radiator and of the motor-driven pump.

In Table 4, when the total required power is minimum at 230 W, the Reynolds number (Re) is 3300 and 4000. It can be confirmed that the Reynolds numbers of 3300 and 4000 fall within the range of 1800 through 6000 which minimizes the power required to cool engine 2. As described above, since the total required power is 230 W at minimum, the further lower power consumption in the case of the lateral flow type radiator than in the case of the longitudinal flow type radiator can be achieved.

The entire contents of a Japanese Patent Application No. 2001-061840(filed in Japan on Mar. 6, 2001) are herein incorporated by reference. The scope of the invention is defined with reference to the following claims.

TABLE 1

| | | | | | | |
|---|---|---|---|---|---|---|
| Q (W) × $10^4$ | 3.4 | 3.4 | 3.4 | 3.4 | 3.4 | 3.4 |
| Va (m/s) | 2.40 | 2.50 | 2.65 | 3.07 | 3.20 | 5.75 |
| Gw (l/min) | 120 | 80 | 60 | 40 | 30 | 20 |

TABLE 2

| | | TOTAL REQUIRED POWER (W) | | | | | |
|---|---|---|---|---|---|---|---|
| | | 901 W | 510 W | 384 W | 316 W | 280 W | 642 W |
| Gw | W | 800 | 400 | 260 | 150 | 100 | 60 |
| | l/min | 120 | 80 | 60 | 40 | 30 | 20 |
| | Re | 1300 | 6900 | 5200 | 3500 | 2600 | 1700 |
| Va | W | 101 | 110 | 124 | 166 | 180 | 582 |
| | Va | 2.40 | 2.50 | 2.65 | 3.07 | 3.2 | 5.75 |

TABLE 3

| | | | | | | | |
|---|---|---|---|---|---|---|---|
| Q (W) × $10^4$ | 3.4 | 3.4 | 3.4 | 3.4 | 3.4 | 3.4 | 3.4 |
| Va (m/s) | 2.40 | 2.42 | 2.52 | 2.66 | 2.78 | 3.08 | 5.11 |
| Gw (l/min) | 120 | 80 | 60 | 40 | 30 | 20 | 10 |

TABLE 4

| | | REQUIRED POWER TOTAL (W) | | | | | | |
|---|---|---|---|---|---|---|---|---|
| | | 900 | 502 | 371 | 274 | 230 | 230 | 370 |
| Gw | W | 800 | 400 | 260 | 150 | 100 | 60 | 20 |
| | l/min | 120 | 80 | 60 | 40 | 30 | 20 | 10 |
| | Re | 20000 | 13000 | 10000 | 6685 | 4000 | 3300 | 1670 |
| Va | W | 100 | 102 | 111 | 124 | 130 | 170 | 350 |
| | Va | 2.40 | 2.42 | 2.52 | 2.66 | 2.78 | 3.08 | 5.11 |

What is claimed is:

1. A cooling system for a water-cooled internal combustion engine, comprising:

a heat exchanger to circulate a coolant flowing out from the water-cooled engine into tubes arranged in a space between headers thereof to cool the coolant;

a pump driven independently of the water-cooled engine to circulate the coolant into the water-cooled engine and the heat exchanger;

a temperature detector to detect a temperature of the coolant;

a controller that drivingly controls the pump on the basis of a detected value of the coolant temperature by the temperature detector in such a manner as to control the drive of the pump for the coolant to be circulated by a predetermined flow quantity, when the temperature of the coolant detected by the temperature detector indicates a value higher than a predetermined target temperature, the heat exchanger being arranged, at the predetermined flow quantity of the coolant, to cause a stream state of the coolant circulated within the tubes of the heat exchanger to fall within a predetermined range including at least one of a transition range between a laminar flow range and a turbulence flow range and a part of the turbulence flow range which is placed in vicinity to the transition range, wherein the heat exchanger is arranged, at the predetermined flow quantity of the coolant, to cause the stream state of the coolant circulated within the tubes of the heat exchanger to fall within a range of 1800 through 6000 in Reynolds number;

a fan that develops an air flow amount supplied to the tubes of the heat exchanger; and a fan motor that drives the fan to rotate so as to develop the air flow amount supplied to the tubes and so as to provide a predetermined air flow quantity for the tubes of the heat exchanger in response to a drive control signal output by the controller on the basis of the detected temperature of the coolant by the temperature detector, wherein the temperature detector detects the coolant temperature at a cylinder block coolant passage through which a cylinder block of the water-cooled engine is cooled, and wherein the controller drivingly controls the pump and the fan motor of the fan so that the Reynolds number falls in the range of 1800 through 6000 when the temperature of the coolant detected by the temperature detector indicates the value higher than the predetermined target temperature.

2. A cooling system for a water-cooled internal combustion engine as claimed in claim 1, wherein the water-cooled engine comprises a cylinder head coolant passage that cools a cylinder head; a cylinder block coolant passage, communicated with the cylinder head coolant passage, that cools a cylinder block, the coolant being introduced from the cylinder head coolant passage and being outputted to the cylinder block coolant passage.

3. A cooling system for a water-cooled internal combustion engine as claimed in claim 1, wherein the pump is a flow quantity adjustable pump driven by an electric motor.

4. A cooling system for a water-cooled internal combustion engine as claimed in claim 1, further comprising an air conditioner bypass passage that circulates the coolant warmed by the water-cooled engine into a heater core of an air conditioner of a vehicle and joins the coolant outputted from the heater core to an upstream side of the pump.

5. A cooling system for a water-cooled internal combustion engine as claimed in claim 4, further comprising a variable valve that is interposed on the air conditioner bypass passage at the upstream side of the heater core and through which a flow quantity of the coolant is enabled to be controlled.

6. A cooling system for a water-cooled internal combustion engine as claimed in claim 1, wherein the heat exchanger comprises a radiator having a plurality of headers between which the tubes are arranged.

7. A cooling system for a water-cooled internal combustion engine as claimed in claim 1, wherein, when the temperature of the coolant detected by the temperature detector is below another predetermined temperature which is below the predetermined target temperature, the controller controls the pump in such a manner that the flow quantity of the pump introduced to the water-cooled engine is controlled to become so small as to prevent the coolant in the engine from locally vaporizing, raising a temperature of the coolant as quickly as possible.

8. A control method applicable to a control system for a water-cooled internal combustion engine, the control system comprising:

a heat exchanger to circulate a coolant flowing out from the water-cooled engine into tubes arranged in a space between headers thereof to cool the coolant;

a pump driven independently of the water-cooled engine to circulate the coolant to the water-cooled engine and the heat exchanger; and a temperature detector to detect a temperature of the coolant, the control method comprising:

determining whether the temperature of the coolant detected by the temperature detector indicates a value higher than a predetermined target temperature;

drivingly controlling the pump on the basis of a detected value of the coolant temperature by the temperature detector in such a manner as to control the drive of the pump for the coolant to be circulated by a predetermined flow quantity, when determining that the temperature of the coolant detected by the temperature detector indicates a value higher than a predetermined target temperature, at the predetermined flow quantity of the coolant;

causing a stream state of the coolant circulated within the tubes of the heat exchanger to fall within a predetermined range including at least one of a transition range between a laminar flow range and a turbulence flow range and a part of the turbulence flow range which is placed in vicinity to the transition range;

controlling a rotation speed of a motor of a fan for the heat exchanger to provide a predetermined air flow amount on the basis of the temperature of the coolant detected by the temperature sensor, wherein the predetermined range within which the flow state of the coolant circulated within the tubes of the heat exchanger falls corresponds to a range of 1800 to 6000 in Reynolds number of the coolant circulated into the tubes of the heat exchanger;

determining whether the fan motor is being operated when the temperature of the coolant detected by the temperature detector indicates the value higher than the predetermined target temperature; and determining whether the pump is driven to circulate the coolant into the water-cooled engine and the heat exchanger by the predetermined flow quantity and to indicate the Reynolds number of the coolant circulated within the tubes of the heat exchanger indicates a predetermined number which falls within the predetermined range of the Reynolds number of 1800 through 6000 when the fan motor is not being operated.

9. A control method applicable to a control system for a water-cooled internal combustion engine as claimed in claim 8, wherein the pump is a motor driven pump and further comprising driving the fan motor to rotate at a predetermined higher speed so that the temperature of the coolant detected by the temperature detector indicates the higher value than the predetermined target temperature when the fan motor is being operated or when the Reynolds number of the coolant circulated with the tubes of the heat exchanger indicates the predetermined number.

10. A control method applicable to a control system for a water-cooled internal combustion engine as claimed in claim 9, wherein, when determining that the temperature of the coolant detected by the temperature detector is equal to or lower than the predetermined target temperature but is higher than another predetermined temperature which is lower than the predetermined target temperature, driving the fan motor to rotate at a predetermined low speed so that the temperature of the coolant detected by the temperature detector indicates the predetermined target temperature when the fan motor is being operated and driving the motor-driven pump to circulate the coolant into the water-cooled engine and the heat exchanger at a predetermined flow velocity.

11. A cooling system for a water-cooled internal combustion engine, comprising:

a heat exchanger to circulate a coolant flowing out from the water-cooled engine into tubes arranged in a space between headers thereof to cool the coolant;

a pump driven independently of the water-cooled engine to circulate the coolant into the water-cooled engine and the heat exchanger;

a temperature detector to detect a temperature of the coolant; and a controller that drivingly controls the pump on the basis of a detected value of the coolant temperature by the temperature detector in such a manner as to control the drive of the pump for the coolant to be circulated by a predetermined flow quantity, when the temperature of the coolant detected by the temperature detector indicates a value higher than a predetermined target temperature, the heat exchanger being arranged, at the predetermined flow quantity of the coolant, to cause a stream state of the coolant circulated within the tubes of the heat exchanger to fall within a predetermined range including at least one of a transition range between a laminar flow range and a turbulence flow range and a part of the turbulence flow range which is placed in vicinity to the transition range, wherein the water-cooled engine comprises a cylinder head coolant passage that cools a cylinder head, a cylinder block coolant passage, communicated with the cylinder head coolant passage, that cools a cylinder block, the coolant being introduced from the cylinder head coolant passage and being outputted to the cylinder block coolant passage, and wherein the coolant is introduced into the cylinder head coolant passage under a temperature state of 80° C. through 95° C. and outputted from the cylinder block coolant passage under another temperature state of 100° C. through 115° C.

* * * * *